US005329734A

United States Patent [19]

Yu

[11] Patent Number: 5,329,734

[45] Date of Patent: Jul. 19, 1994

[54] POLISHING PADS USED TO CHEMICAL-MECHANICAL POLISH A SEMICONDUCTOR SUBSTRATE

[75] Inventor: Chris C. Yu, Austin, Tex.

[73] Assignee: Motorola, Inc., Schaumburg, Ill.

[21] Appl. No.: 54,168

[22] Filed: Apr. 30, 1993

[51] Int. Cl.[5] ..... B24B 7/22

[52] U.S. Cl. ..... 51/283 R; 51/209 DL; 51/DIG. 34

[58] Field of Search ..... 51/283 R, 209 R, 209 DL, 51/395, DIG. 34, 131.1, 131.3, 133, 123

[56] References Cited

U.S. PATENT DOCUMENTS

| | | | |
|---|---|---|---|
| 4,313,284 | 2/1982 | Walsh | 51/131.4 |
| 4,511,605 | 4/1985 | McCartney | 427/246 |
| 4,613,345 | 9/1986 | Thicke et al. | 51/293 |
| 4,821,461 | 4/1989 | Holmstrand | 51/209 DL |
| 4,841,680 | 6/1989 | Hoffstein et al. | 51/283 R |
| 4,927,432 | 5/1990 | Budinger et al. | 51/298 |
| 5,020,283 | 6/1991 | Tuttle | 51/209 DL |
| 5,036,630 | 8/1991 | Kaanta et al. | 51/283 R |
| 5,081,051 | 1/1992 | Mattingly et al. | 437/10 |
| 5,173,441 | 12/1992 | Yu et al. | 437/173 |
| 5,216,843 | 6/1993 | Breivogel et al. | 51/131.1 |
| 5,232,875 | 8/1993 | Tuttle et al. | 51/131.3 |

FOREIGN PATENT DOCUMENTS

| | | | |
|---|---|---|---|
| 0051705 | 12/1980 | Japan | 51/395 |
| 3213265 | 9/1991 | Japan | 51/131.3 |

*Primary Examiner*—Robert A. Rose
*Attorney, Agent, or Firm*—George R. Meyer

[57] ABSTRACT

The present invention includes a polishing pad to improve polishing uniformity across a substrate and a method using the polishing pad. The polishing pad has a first region that lies closer to the edge of the polishing pad and a second region that lies further from the edge of the polishing pad. The second region has a plurality of openings or a larger average pore size compared to the first region. Each opening or the average pore size of the second region may be 1) between about 250–1000 microns or 2) in a range of about 25–1000 percent larger than the average pore size of the first region. The polishing pad may be used in a chemical-mechanical polishing without having to substantially changing the polisher or the operational parameters of the polisher other than the oscillating range.

27 Claims, 5 Drawing Sheets

-PRIOR ART-

-PRIOR ART-

POLISHING PADS USED TO CHEMICAL-MECHANICAL POLISH A SEMICONDUCTOR SUBSTRATE

RELATED APPLICATION

This is related to U.S. patent application Ser. No. 08/054,167 filed Apr. 30, 1993.

FIELD OF THE INVENTION

The present invention relates to the field of semiconductor devices, and in particular, to polishing pads used in chemical-mechanical polishing semiconductor substrates.

BACKGROUND OF THE INVENTION

Planarization of semiconductor substrates is becoming more important as the number of layers used to form a semiconductor device increases. Nonplanar semiconductor substrates have many problems including difficulty in patterning a photoresist layer, formation of a void within a film during the film deposition, and incomplete removal of a layer during an etch process leaving residual portions of the layer, which are sometimes called "stringers." A number of planarization processes have been developed and include chemical-mechanical polishing.

FIGS. 1 and 2 include illustrations of a part of one type of a chemical-mechanical polisher that is used to polish semiconductor substrates. FIG. 1 is a cross-sectional view of a chemical-mechanical polisher 10. The polisher 10 has a platen 14 and a polishing pad 11 attached to the platen 14 with an adhesive compound (not shown). Above the polishing pad 11 are substrate holders 12, and each substrate holder 12 has a semiconductor substrate 13. The polisher 10 also includes a polishing slurry and a slurry feed, both of which are not shown. The polishing pad 11 may be made of a porous polyurethane material that has a relatively uniform thickness of about 1–2 millimeters. FIG. 2 includes a top view illustrating the relationships of motion between the polishing pad 11 and the substrates 13. During polishing, the polishing pad 11 rotates counterclockwise or clockwise, but the substrates 13 typically rotate in the same direction as the polishing pad 11. While the substrates 13 and polishing pad 11 are rotating, the substrates 13 are being oscillated back and forth across the polishing pad. The oscillating motion covers a distance called an oscillating range and is performed at an oscillating velocity. While the polishing is being performed, the polishing slurry may be recycled.

In actual use, chemical-mechanical polishing typically has nonuniform polishing rates across a substrate surface. In many cases, the polishing rate near the edge of the substrate is higher than the polishing rate near the center of the substrate because the relative velocity between polishing pad and the substrate is higher near the edge of the substrate compared to the center of the substrate. Therefore, some area of the substrate near the center may be underpolished, some area of the substrate near the edge may be overpolished, or both.

The polishing pad may contribute to the nonuniformity. A brief overview of the formation of polyurethane polishing pads is now presented. Polyurethane polishing pads are typically formed by reacting the chemicals that form polyurethane within a cylindrical container. After forming a cylindrical-shaped piece of polyurethane, the piece is cut into slices that are subsequently used as polishing pad. The polishing pad typically has pores that have a size of about 100–200 microns. Although the pores may vary in size, the average pore size for any region of the polishing pad is typically about the same as any other region of the polishing pad. As used hereinafter, this type of prior art polishing pad is referred to as a conventional polishing pad. The nonuniformity occurs because the edge of the substrate is moving faster relative to the polishing pad compared to the center of the substrate and the conventional polishing pad does not have a feature to compensate of the polishing nonuniformity.

The prior art has addressed the problem of nonuniformity polishing by modifying a conventional polishing pad by forming a pattern within the polishing pad. These polishing pads include forming a variety of geometric patterns including openings. It should be kept in mind that polishing pads are typically porous, and the pores are formed during the reaction to form the polishing pad material. As used in this specification, openings are distinguished from pores because openings are formed within the pad after the reaction to form the polishing pad material has occurred. A conventional polishing pad has pores but does not have any openings. The prior art polishing pad with openings typically have a width on the order of centimeters, or the prior art polishing pad has a density of openings that decreases with the distance from edge of the polishing pad.

SUMMARY OF THE INVENTION

The present invention includes a polishing pad to improve polishing uniformity across a substrate and a method using the polishing pad. The polishing pad has a first region adjacent to the edge of the polishing pad and a second region that is adjacent to the first region and further from the edge of the polishing pad. The polishing pad is configured such that second region has a plurality of openings or has an average pore size that is larger than the average pore size of the first region. The present invention also includes openings within the first region, wherein the width or density of openings within the first region is smaller than the width or density of openings within the second region. The polishing pad may be used in a chemical-mechanical polishing without having to substantially change the equipment or the operational parameters of the polisher other than oscillating range.

Other features and advantages of the present invention will be apparent from the accompanying drawings and from the detailed description that follows.

BRIEF DESCRIPTION OF THE DRAWINGS

The present invention is illustrated by way of example and not limitation in the figures of the accompanying drawings, in which like references indicate similar elements, and in which.

DETAILED DESCRIPTION OF THE EMBODIMENTS

The present invention includes a polishing pad to improve polishing uniformity across a substrate and a method using the polishing pad. The polishing pad has a first region adjacent to the edge of the polishing pad and a second region that is adjacent to the first region and further from the edge compared to the first region. As is discussed in more detail below, the second region has a plurality of openings or a larger average pore size compared to the first region. Equipment modifications and polishing parameters are not substantially affected when using a polishing pad of the present invention except for oscillating range.

Polishing Pad with Openings

Figure 1:
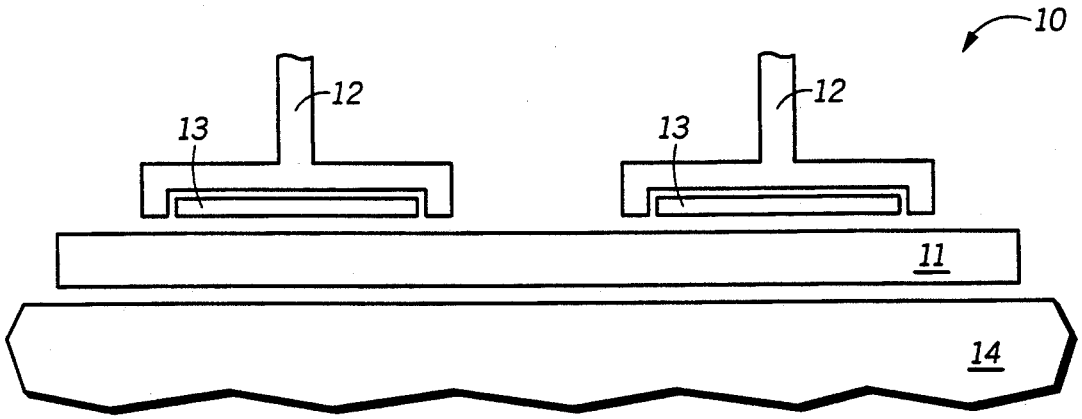
FIGS. 1 and 2 include cross-sectional and top views, respectively, of a polishing pad and substrates. (Prior art)
Figure 2:
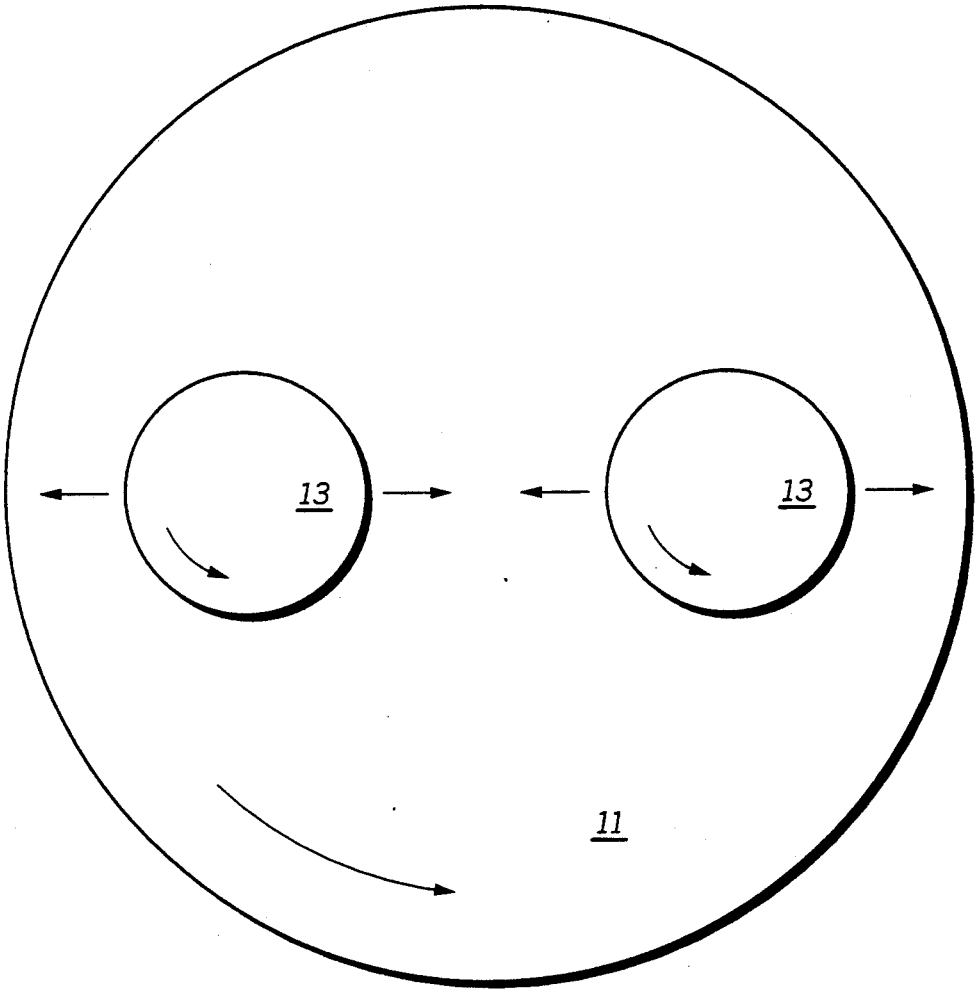
Figure 3:
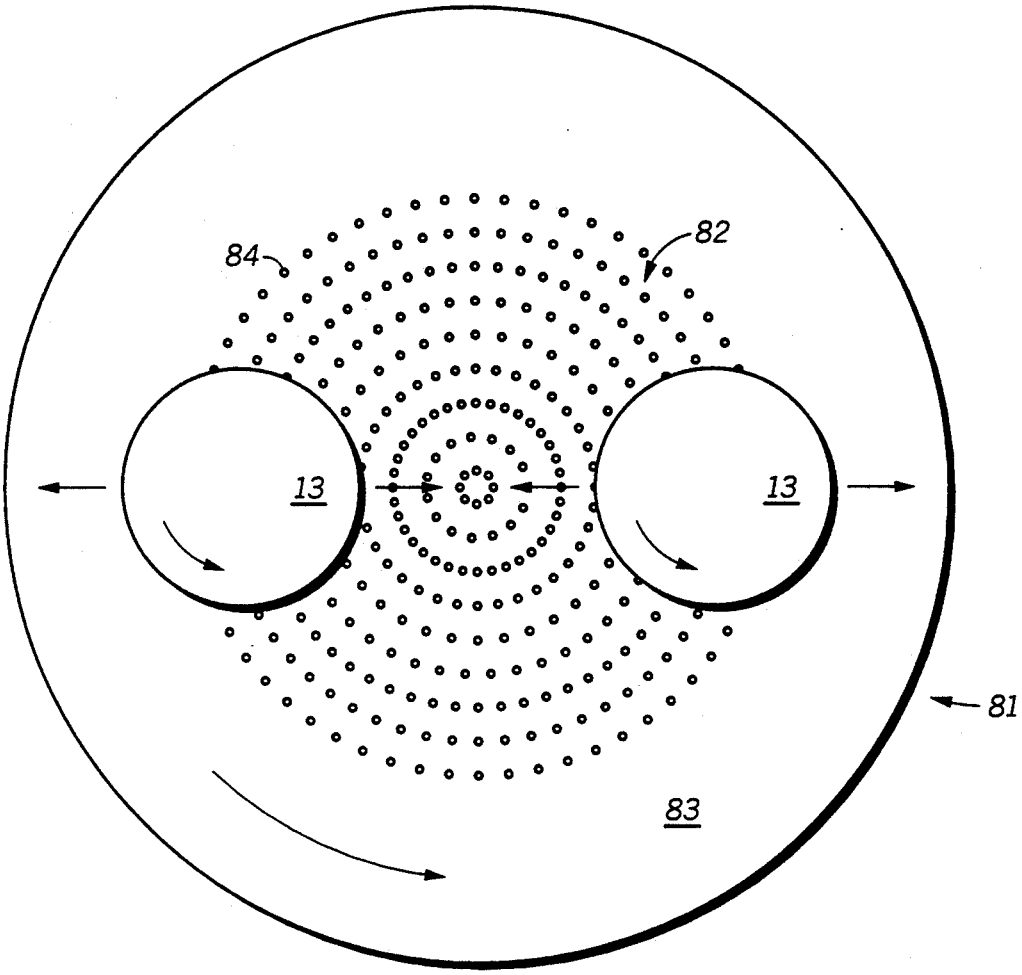
FIGS. 3–4 include top and cross-sectional views, respectively, of a polishing pad and substrates, wherein the polishing pad has a plurality of openings in accordance with one embodiment of the present invention.

All of the polishing pads in FIGS. 3-7 include of a porous polyurethane material that has an average pore size about 100-200 microns. FIG. 3 includes an illustration of a polishing pad 81 having a plurality of openings in accordance with one embodiment of the present invention. Polishing pad 81 has a first region 83 and a second region 82. The thickness of the polishing pad 81 is substantially uniform across its surface. The second region 82 has a plurality of openings 84. Each opening 84 has a width that is in a range of 1) about 250-1000 microns or 2) about 25-1000 percent larger than the average pore size. Cumulatively, the openings 84 occupy in a range of about 5-50 percent of the polishing surface area within region 82. For example, region 82 may have a plurality of openings 84 that are each about 500 microns, and the total surface area of region 82 that is occupied by the openings 84 may be about 30 percent. The rotational and oscillating directions of motion of the polishing pad 81 and the substrates 13 are shown in FIG. 3. The openings 84 within the second region 82 help to increase the polishing rate within the second region 82 compared to a conventional polishing pad that does not have any openings. Because the substrate 13 is rotating during the polishing, the edge of the substrate is exposed to the openings 84 only a portion of the time, while the center of the substrate 13 is virtually always overlying the second region 82 that includes the openings 84. At the first region 83, the higher relative velocity between the substrate 13 and the pad 81 causes an increased polishing rate, while a shorter, if any, exposure time to the openings 84 causes a decreased polishing rate. In the second region 82, the lower relative velocity between the substrate 13 and the pad 81 causes a decreased polishing rate, while the longer exposure time to the openings 84 causes an increased polishing rate. In this manner the polishing rate of the substrate 13 may be made more uniform across the primary surface of the substrate 13 compared to the prior art polishing pad 11.

Figure 4:
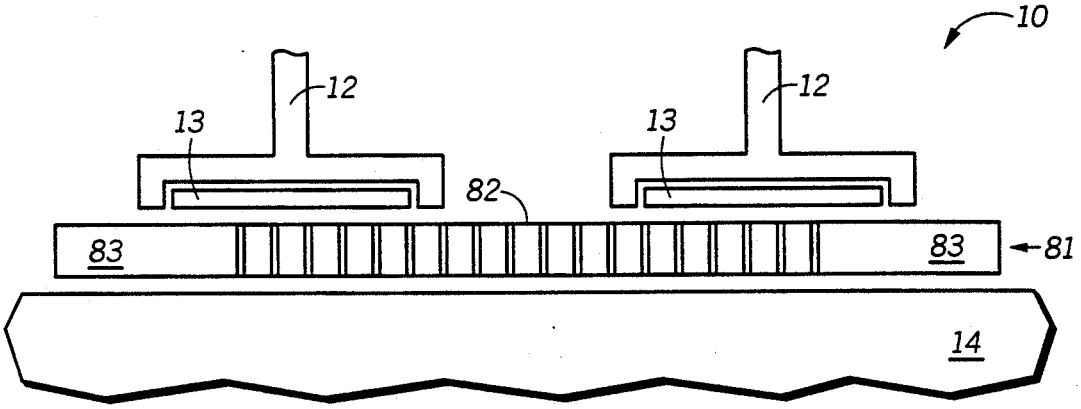

FIG. 4 includes a cross-sectional view of the polisher 10 with the polishing pad 81. The polishing pad 81 is attached to the platen 14 with an adhesive compound (not shown). The substrates 13 are held by the substrate holders 12. The center point of the substrate should always be over the region 82 of the polishing pad 81. If the region 82 is too large, the polishing rate across the substrate may not be uniform enough. On average, about 20-80 percent of the primary surface of each substrate is in contact with region 82 during polishing. Therefore, region 82 extends a distance of about 50-80 percent from the center of the polishing pad to the edge of the polishing pad. The openings 84 are shown extending through the polishing pad 81. The openings 84 help the polishing slurry to move through the polishing pad 81.

Figure 5:
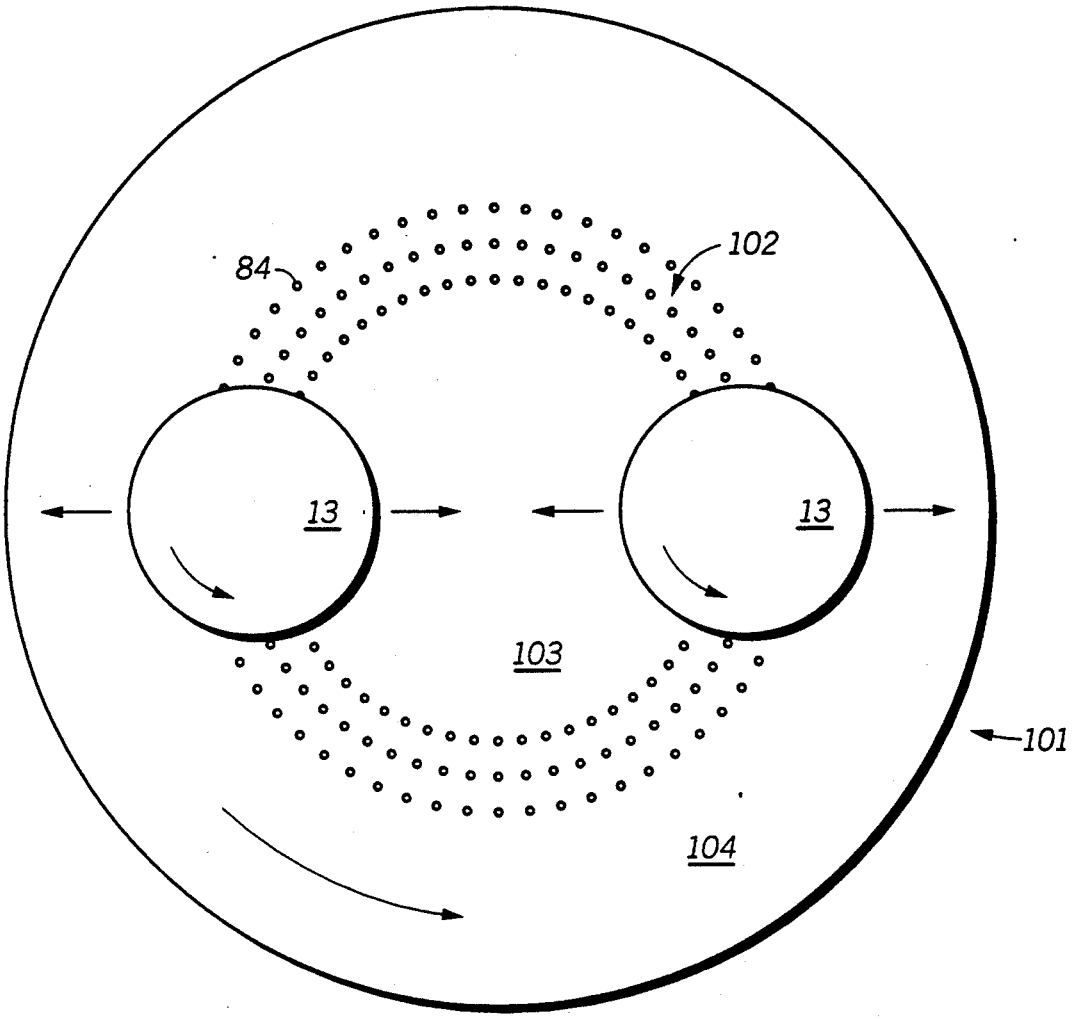
FIGS. 5–6 include top and cross-sectional views, respectively, of a polishing pad and substrates, wherein the polishing pad has a plurality of openings in accordance with another embodiment of the present invention.

FIG. 5 illustrates another embodiment of the present invention. A polishing pad 101 has three regions including a first region 104, a second region 102, and a third region 103. The second region 102 has a band of openings 84 that are similar in shape and in density to the openings 84 within the second region 82 of the polishing pad 81. Although FIG. 5 illustrates the first region 104 and the third region 103 to have no openings 84, either or both may have openings. The width of the openings within the region 104 should not be any wider than the width of openings within region 103, or the density of openings within the region 104 should not be any higher than the density of openings within region 103. The width of the openings within the region 103 should not be any wider than the width of openings 84 within region 102, or the density of openings within the region 103 should not be any higher than the density of openings 84 within region 102.

Figure 6:
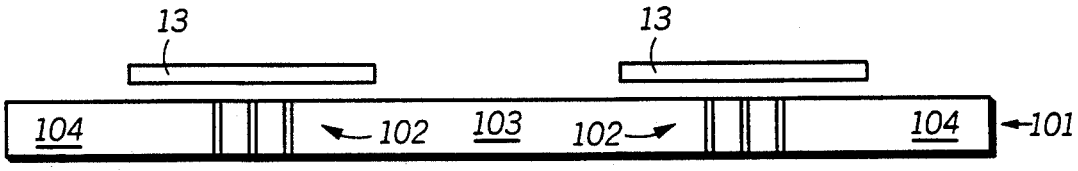

FIG. 6 illustrates a cross-sectional view of polishing pad 101 and substrates 13. The width of the second region 102 is about 20-80 percent of a dimension of the primary surface of the substrate 13. If substrate 13 would be a wafer about 200 millimeters in diameter, then the primary surface dimension would be about 200 millimeters. If the width of the second region 102 would be about 50 percent of the primary surface dimension of the wafer, the width of the second region 102 would be about 100 millimeters wide. This example is to illustrate and not to limit the invention.

Figure 7:
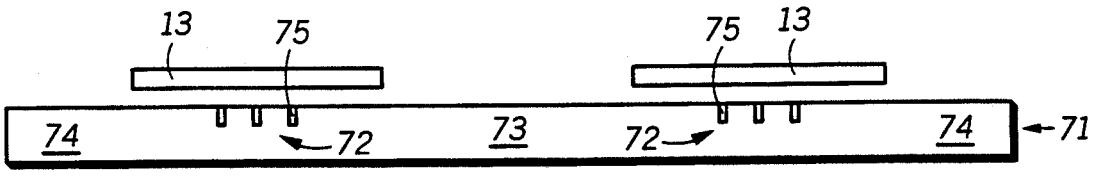
FIG. 7 includes a cross-sectional view of a polishing pad and substrates, wherein the polishing pad has a plurality of openings in accordance with another embodiment of the present invention.

FIG. 7 includes an illustration of another embodiment of the present invention. FIG. 7 includes a polishing pad 71 that is similar to the polishing pad 101 of FIGS. 5 and 6. Polishing pad 71 includes a first region 74, a second region 72, and a third region 73. Unlike FIGS. 5 and 6, the openings 75 extend only partially through the polishing pad 74. In general, the depth of the openings 75 should be as least as large as the difference in topography along the surface of the substrates 13. For example, if the difference in topography along the surface of one of the substrates 13 is about two microns, the depth of the openings 84 should be at least about two microns. In other words, the openings 75 must extend at least about two microns down from the surface of the polishing pad 71. In FIG. 7, the openings 75 extend about half way through the polishing pad 71. The openings 75 are about 0.5-1.0 millimeters deep depending on the thickness of the polishing pad 74.

The manufacturing of the polishing pads is not expected to be difficult and may be performed in different manners. The openings 75 or 84 may be formed by laser ablation, or possibly machining the polishing pad by drilling. Laser ablation is used in scribing identification marks onto silicon substrates, and a YAG or excimer laser may be used in the laser ablation. The manner for forming the openings by laser ablation would be similar to the method used for scribing wafers. Drilling the openings 75 or 84 may be performed, but the drilling machine needs to be able to form the small widths of the openings and have good precision so that the opening density may be controlled. Currently, computer-controlled machine tools are expected to be capable of forming the openings by drilling.

Polishing Pad with Varying Pore Size

Figure 8:
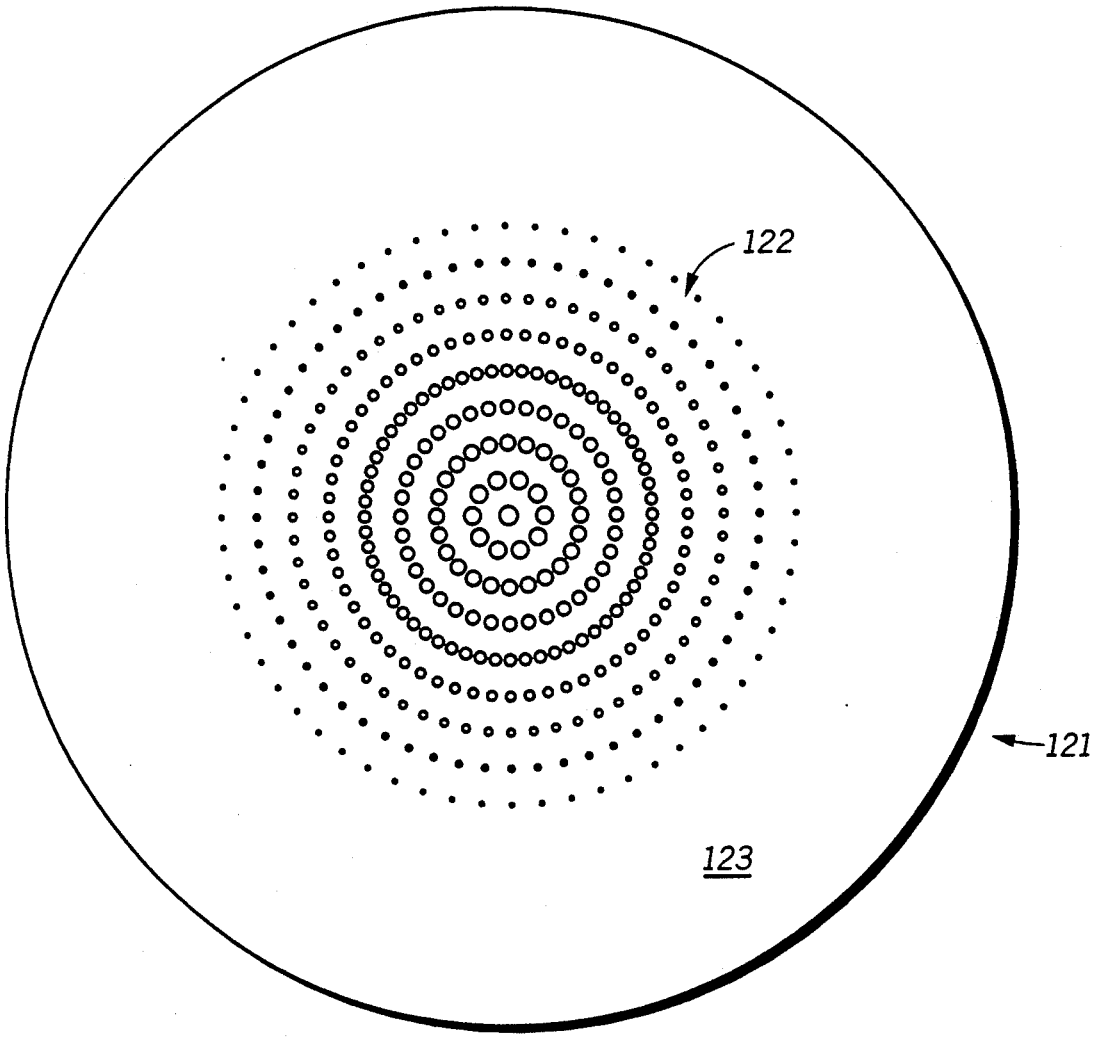
FIGS. 8-9 include top views of a polishing pad and substrate, wherein the polishing pad has a region with larger average pore size in accordance with another embodiment of the present invention.
Figure 9:
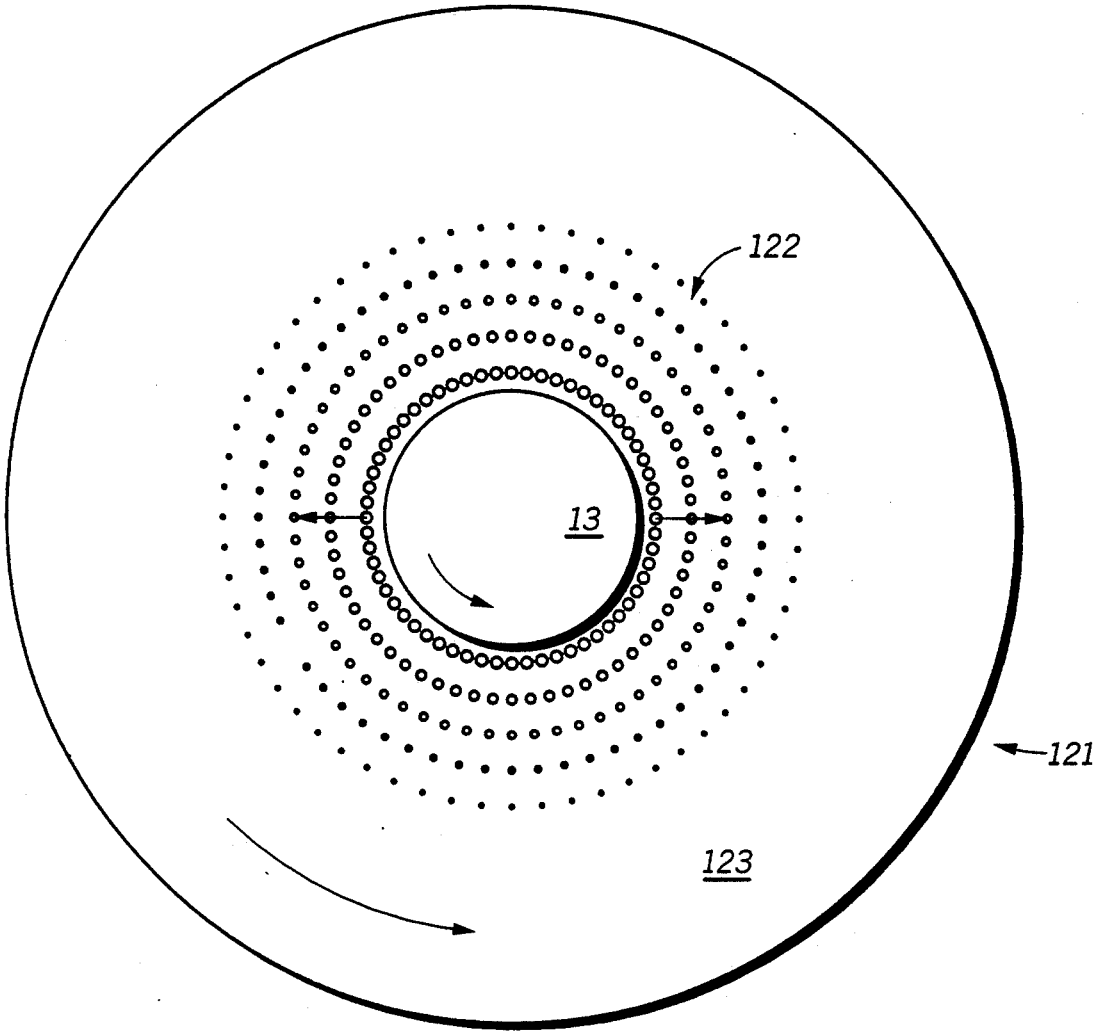

In an embodiment shown in FIG. 8, a polishing pad 121 is formed with average pore size that vary across the surface of the polishing pad. Region 122 has pores with an average pore size that decreases with the distance from the center of the polishing pad 121. Region 123 has an average pore size that is roughly equivalent to the average pore size of a conventional polishing pad. Therefore, region 123 has an average pore size of about 100–200 microns wide, while region 122 has an average pore size that is in a range of 1) about 250–1000 microns or 2) about 25–1000 percent larger than the average pore size of region 123. The larger average pore size may be formed by locally heating a portion of the polishing pad while the reaction to form the polishing pad occurs. In one method to form the polishing pad, a heat probe is placed within the reacting cylinder used to form a cylindrical block of polyurethane. The heat probe would traverse the cylinder along its radial centerline, and the probe would be on while the chemicals react to form polyurethane. The locally higher temperature near the center of the cylinder should cause larger pores to form near the center of the cylinder compared to the edge of the cylinder. In still another embodiment, electromagnetic radiation, such as microwaves and the like, may be focused such that the radiation causes local heating where larger pores are to be formed. If the radiation is focused and the cylinder is rotated during the polyurethane reaction, a band of larger pores may be formed at a location similar to the openings 84 of the polishing pad 101 of FIGS. 5 and 6. Neither process is destructive meaning that the polyurethane polishing pad has virtually the same characteristics of a conventional polishing pad except that the pore size varies. The methods listed above for forming the polyurethane pad are illustrative and are not to be considered limiting.

Polishing with the Polishing Pads

The polishing pads of the present invention may be used in virtually any application of chemical-mechanical polishing of semiconductor substrates. No special equipment modifications should be required. Many of the operating parameters when using any one of the polishing pads should be similar to the operating parameters using a conventional polishing pad. Any one of the polishing pad as illustrated in FIGS. 3–9 is attached to the platen 14 of the polisher 10 similar to a conventional polishing pad. The substrate holders 12 and the substrates 13 do not need to be treated or modified. The slurry composition, platen rotational velocity, and substrate rotational velocity are all expected to be within the normal operating parameters of a polisher that would have a conventional polishing pad. The oscillating range may be more that what is typically used in the prior art. Slight adjustment to other operating parameters may be needed to optimize polishing performance.

The oscillating motion includes an oscillating range and an oscillating velocity. The oscillating range depends on a dimension of the primary surface of the substrate to be polished and a dimension of the second region of the polishing pad and the size of the semiconductor substrate. Typically, a semiconductor substrate oscillates in either direction no more than about 40 percent of the dimension of the primary surface. The oscillating range is typically a distance that is no more than 80 percent of a dimension of the primary surface of the semiconductor substrate. A limitation on the oscillating range is that the center point of the semiconductor substrate should always overlie the second region of the polishing pad during the polishing step. Another limitation on the oscillating range is that the edge of the semiconductor substrate should not extend beyond the edge of the polishing pad during polishing. The semiconductor substrate should be moved so that the outermost point of the semiconductor substrate lines up with the outermost point of the second region of the polishing pad some time during the polishing step. The reference point for "outermost" is the center of the polishing pad. Therefore, the outermost point of the semiconductor substrate is that point which is furthest from the center of the polishing pad, and the outermost point of the second region is that point which is furthest from the center of the polishing pad. In most applications, the oscillating range is a distance that is in a range of 5–50 percent of the dimension of the primary surface of the semiconductor substrate.

For example, assume that the semiconductor substrate is a wafer having a diameter of about 150 millimeters and that the polishing pad of FIGS. 5 and 6 is used. In a first case, assume that the width of the region 102 is about 33 percent of the diameter of the wafer or about 50 millimeters. When wafer would be centered over region 102 similar to FIG. 6, the semiconductor substrate extends about 50 millimeters beyond each edge of the region 102. Therefore, the semiconductor substrates 13 oscillate about 25 millimeters to the right and about 25 millimeters to the left. The oscillating range is about 50 millimeters. If the oscillating range in this case is reduced, the outermost point of the wafer does not line up the outermost point of the region 102. If the oscillating range in this case is increased, the center point of the wafer does not overlie the region 102 during at least some portion of the polishing step.

In a second case, assume that the width of region 102 is about 80 percent of the diameter of the wafer or about 120 millimeters. The semiconductor substrates 13 are oscillated at least about 15 millimeters in each direction, so that the outermost point of the wafer line up with the outermost portion of region 102 during the polishing step. The oscillating range is at least about 30 millimeters. The semiconductor substrates 13 are oscillated no more than about 60 millimeters in each direction, so that the center point of the wafer always overlies region 102 during the polishing step. The oscillating range is no more than about 120 millimeters. In this case, the semiconductor substrates 13 are oscillated in a range of about 15–60 millimeters in each direction. The oscillating range is about 30–120 millimeters. The oscillating velocity is in a range of about 1–10 millimeters per second for either of the cases described.

Benefits

The present invention includes many benefits. The polishing pads of the present invention may be used in many commercial chemical-mechanical polishers without any significant changes to the equipment. The polishing parameters other than lateral back and forth motion are not expected to be significantly changed. Although the lateral motion may change, little or no adjustment to the other processing parameters may be necessary in order to achieve optimal polishing of the semiconductor substrate.

The polishing pads of the present invention are expected to have more uniform polishing characteristics. Many of the prior art polishing pads have geometric patterns that are supposed to increase polishing rate and uniformity. In particular, one prior art polishing pad has an opening density that is higher toward the edge of the polishing pad. Contrary to the beliefs of the prior art, I believe that pad with its higher opening density near the edge is expected to contribute to further polishing non-uniformity. It should be kept in mind that the platen and semiconductor substrates typically rotate in the same direction. Therefore, the relative velocity of the semiconductor substrate to the polishing pad is the highest at the edge of the semiconductor substrate when it is the closest to the edge of the polishing pad. Unlike the prior art, the present invention helps to increase the polishing rate at the center of the substrate more than it helps to increase the polishing rate near the edge of the substrate. The polishing rate is more uniform across the primary surface of the substrate because slurry transport and polishing product removal from the second regions 72, 82, or 102 is enhanced.

The openings or larger average pore size help to decrease the likelihood that the pores 74 or the pores adjacent to the openings 84 within the second region 72, 82, or 102 become clogged compared to a conventional pad. If the pores become clogged, the polishing rate at the location where the pore is located generally decreases. Therefore, polishing pads of the present invention are expected to have a more uniform polishing rate because the pores adjacent to the pores 74 and openings 84 are less likely to become clogged.

The polishing pads of the present invention are expected to last longer because the pores are less likely to become clogged. After the pores become clogged, a polishing pad may need to be replaced or "reconditioned." Reconditioning is performed with an abrading tool, such as a diamond disk and the like. The reconditioning is typically a destructive process because pores in the polishing pad material near the surface of the polishing pad are almost always ripped open during reconditioning. Reconditioning usually reduces the lifetime of the polishing pad because reconditioning is a destructive operation. The present invention should extend the lifetime of a polishing pad because the larger pores or openings reduce the likelihood of pores becoming clogged. The present invention is not expected to require reconditioning.

The pores 74 or openings 84 are on the order of hundreds of microns. If the pores or openings are too large, such as on the order of centimeters, a center of the substrate would spend a large time over these very large openings. In general, the local polishing rate of a point on the substrate is low or close to zero when the point is over an opening compared to a point that does not lie over an opening. When the openings are too large, part of the substrate is spending too much time over an opening, which should decrease the polishing rate. In addition, each opening can only reduced pore clogging over a limited area immediately adjacent to the opening. When very large openings are used, the polishing pad may have points on the polishing pad that are far enough away from the very large openings where pore clogging may still occur. By keeping the size of the pores or openings on the order of hundreds of microns, the density of these pores or openings may be adjusted to help reduce the likelihood of pore clogging.

The polishing pads of the present invention may not need to be conditioned prior to using them. The conditioning may include rubbing with an abrading tool or processing dummy wafers. The abrading tool is actually destructive to the polishing pad. A polishing pad can generally process a finite number of substrates before the polishing pad needs to be replaced. If dummy wafers are processed, the number of substrates that can be processed on that same polishing pad may be less than if dummy wafers were not processed. By not conditioning the pad, the polishing pad may process a larger number of substrates.

The present invention is not limited by the embodiments or materials listed herein. The polishing pads of the present invention may be used on a polisher capable of polishing any number of semiconductor substrates during the same polishing step.

In the foregoing specification, the invention has been described with reference to specific embodiments thereof. It will, however, be evident that various modifications and changes can be made thereto without departing from the broader spirit or scope of the invention as set forth in the appended claims. The specification and drawings are, accordingly, to be regarded in an illustrative rather than a restrictive sense.

What is claimed is:

1. A polishing pad for polishing a semiconductor substrate, wherein the polishing pad comprises:
- an edge;
- a plurality of pores having an average pore size;
- a first region that is adjacent to the edge; and
- a second region having a plurality of openings, wherein:
  - the second region is adjacent to the first region;
  - the second region is further from the edge compared to the first region; and
  - each opening of the plurality of openings has a width that is in a range of about 25–1000 percent larger than the average pore size.

2. The polishing pad of claim 1, wherein each opening of the plurality of openings has a width of about 250–1000 microns.

3. The polishing pad of claim 1, wherein:
- the polishing pad has a polishing surface area; and
- the plurality of openings occupies about 5–50 percent of the polishing surface area within the second region.

4. The polishing pad of claim 1, wherein:
- the first region includes a plurality of openings and a first opening density;
- the second region has a second opening density; and
- the second opening density is higher than the first opening density.

5. The polishing pad of claim 1, wherein:
- the first region includes a plurality of openings having a first average opening width;
- the plurality of openings of the second region has a second average opening width; and
- the second average opening width is wider than the first average opening width.

6. The polishing pad of claim 1, further comprising a third region, wherein:
- the third region is adjacent to the second region;

the third region is furthest from the edge compared to the first and second regions;

the third region includes a plurality of openings having a third average opening width and a third opening density;

the second region has a second opening density; and the polishing pad has a configuration selected from a group consisting of:

the second opening density is no less than the third opening density; and the second average opening width is no less than the third average opening width.

7. A polishing pad for polishing a semiconductor substrate, wherein the polishing pad comprises:

an edge;

a first region that has a first average pore size and is adjacent to the edge; and a second region that has a second average pore size, wherein:

the second region is adjacent to the first region;

the second region is further from the edge compared to the first region; and the second average pore size is larger than the first average pore size.

8. The polishing pad of claim 7, wherein the second average pore size in a range of about 25–1000 percent larger than the first average pore size.

9. The polishing pad of claim 7, wherein the second average pore size is in a range of about 250–1000 microns.

10. The polishing pad of claim 7, further comprising a third region that has a third average pore size, wherein:

the third region is adjacent to the second region;

the third region is furthest from the edge compared to the first and second regions; and the third average pore size is no larger than the second average pore size; and the third average pore size is no smaller than the first average pore size.

11. A method of polishing a semiconductor substrate having a center point and a primary surface having a primary surface dimension, wherein the method comprises the steps of:

placing the substrate in a polisher; and polishing the substrate with a polishing pad, wherein the polishing pad includes:

an edge;

a plurality of pores having an average pore size, a first region that is adjacent to the edge; and a second region having a plurality of openings, wherein:

the second region is adjacent to the first region;

the second region is further from the edge compared to the first region; and each opening of the plurality of openings has a width that is in a range of about 25–1000 percent larger than the average pore size.

12. The method of claim 11, wherein the polishing step is performed such that the center point of the substrate is always over the second region during the polishing step.

13. The method of claim 11, wherein the polishing step includes oscillating the semiconductor substrate across a portion of the polishing pad, wherein the oscillating:

covers an oscillating range that is a distance in a range of about 5–50 percent of the primary surface dimension; and is performed at an oscillating velocity that is in a range of about 1–10 millimeters per second.

14. A method of polishing a semiconductor substrate having a center point and a primary surface having a primary surface dimension, wherein the method comprises the steps of:

placing the substrate in a polisher; and polishing the substrate with a polishing pad, wherein the polishing pad includes a substrate polishing region having:

an edge;

a first region that has a first average pore size and is adjacent to the edge; and a second region that has a second average pore size, wherein:

the second region is adjacent to the first region;

the second region is further from the edge compared to the first region; and the second average pore size is larger than the first average pore size.

15. The method of claim 14, wherein the polishing step is performed such that the center point of the substrate is always over the second region during the polishing step.

16. The method of claim 14, wherein the polishing step includes oscillating the semiconductor substrate across a portion of the polishing pad, wherein the oscillating:

covers an oscillating range that is a distance in a range of about 5–50 percent of the primary surface dimension; and is performed at an oscillating velocity that is in a range of about 1–10 millimeters per second.

17. A polishing pad for polishing a semiconductor substrate, wherein the polishing pad comprises:

an edge;

a first region that is adjacent to the edge and includes a plurality of openings, wherein the first region has a first opening density and a first average opening width; and a second region, wherein the second region:

is adjacent to the first region; and is further from the edge compared to the first region has a plurality of openings, wherein the second region has a second opening density and a second average opening width, wherein the polishing pad has a configuration selected from a group consisting of:

the second opening density is higher than the first opening density; and the second average opening width is wider than the first average opening width.

18. A polishing pad for polishing a semiconductor substrate, wherein the polishing pad comprises:

an edge;

a plurality of pores having an average pore size;

a first region that is adjacent to the edge;

a second region having a plurality of openings and a second opening density, wherein the second region:

is adjacent to the first region; and is further from the edge compared to the first region; and a third region having a plurality of openings and a third opening density, wherein:
the third region is adjacent to the second region;
the third region is furthest from the edge compared to the first and second regions; and
the second opening density is no less than the third opening density.

19. The method of claim 11, wherein each opening has a width in a range of about 250–1000 microns.

20. The method of claim 11, wherein:
the polishing pad has a polishing surface area; and
the plurality of openings occupies about 5–50 percent of the polishing surface area within the second region.

21. The method of claim 11, wherein:
the first region includes a plurality of openings and a first opening density;
the second region has a second opening density; and
the second opening density is higher than the first opening density.

22. The method of claim 11, wherein:
the first region includes a plurality of openings having a first average opening width;
the plurality of openings of the second region has a second average opening width; and
the second average opening width is wider than the first average opening width.

23. The method of claim 11, wherein the polishing pad further comprises a third region, wherein:
the third region is adjacent to the second region;
the third region is furthest from the edge compared to the first and second regions;
the third region includes a plurality of openings and a third opening density;
the second region has a second opening density; and
the polishing pad has a configuration selected from the group consisting of:
the second opening density is no less than the third opening density; and
the second average opening width is no less than the third average opening width.

24. A method of polishing a semiconductor substrate having a center point and an edge point comprising the steps of:
placing the substrate in a polisher having a polishing pad including a plurality of pores having an average pore size; and
polishing the substrate with the polishing pad by rotating the polishing pad and oscillating the substrate across at least a portion of the polishing pad, wherein:
the polishing pad includes:
a center region that is defined by only that portion of the polishing pad that underlies the center point of the substrate during the step of polishing;
an edge;
an edge region that is defined by that portion of the polishing pad lying between the center region and the edge;
the center region includes a plurality of center openings having an average center opening width and a center opening density;
the edge region has a characteristic selected from a group consisting of:
no openings; and
edge openings having an average edge opening width and an edge opening density;
the polishing pad has a configuration selected from a group consisting of:
each center opening of the plurality of openings has a width that is in a range of about 25–1000 percent larger than the average pore size and in a range of about 250–1000 microns;
the average center opening width is wider than the average edge opening width; and
the center opening density is higher than the edge opening density; and
the step of polishing is performed such that the edge point of the substrate does not extend beyond the edge of the polishing pad.

25. The method of claim 24, wherein the polishing pad further comprises an inner region that is defined by that portion of the polishing pad lying furthest from the edge and adjacent to the center region, wherein:
the inner region includes a plurality of inner openings having an average inner opening width and an inner opening density; and
the polishing pad has a configuration selected from a group consisting of:
the average center opening width is wider than the average inner opening width; and
the center opening density is higher than the inner opening density.

26. The method of claim 24, wherein:
the substrate includes a primary surface and a primary surface dimension;
the oscillating:
covers an oscillating range that is a distance in a range of about 5–50 percent of the primary surface dimension; and
is performed at an oscillating velocity that is in a range of about 1–10 millimeters per second.

27. The process of claim 24, wherein the plurality of center openings occupies about 5–50 percent of the area of the center region.

* * * * *